US010723491B2

(12) United States Patent
Miyata

(10) Patent No.: US 10,723,491 B2
(45) Date of Patent: Jul. 28, 2020

(54) ARTICLE LOADING APPARATUS

(71) Applicant: DAIKYO SEIKO LTD., Sano-shi, Tochigi (JP)

(72) Inventor: Haruo Miyata, Sano (JP)

(73) Assignee: DAIKYO SEIKO LTD., Sano-Shi, Tochigi (JP)

( * ) Notice: Subject to any disclaimer, the term of this patent is extended or adjusted under 35 U.S.C. 154(b) by 189 days.

(21) Appl. No.: 16/035,093

(22) Filed: Jul. 13, 2018

(65) Prior Publication Data

US 2019/0031375 A1 Jan. 31, 2019

(30) Foreign Application Priority Data

Jul. 25, 2017 (JP) ..... 2017-143571

(51) Int. Cl.

| | |
|---|---|
| ***B65B 1/10*** | (2006.01) |
| ***B65B 43/60*** | (2006.01) |
| ***B65B 43/54*** | (2006.01) |
| ***B65B 67/04*** | (2006.01) |
| ***B65B 43/42*** | (2006.01) |

(Continued)

(52) U.S. Cl.

CPC ..... *B65B 1/10* (2013.01); *B65B 1/30* (2013.01); *B65B 39/06* (2013.01); *B65B 43/42* (2013.01); *B65B 43/54* (2013.01); *B65B 43/60* (2013.01); *B65B 55/022* (2013.01); *B65B 67/04* (2013.01); *B65B 35/04* (2013.01); *B65B 39/00* (2013.01); *B65B 39/001* (2013.01); *B65H 7/04* (2013.01); *B65H 31/06* (2013.01)

(58) Field of Classification Search

CPC .. B65B 1/10; B65B 1/30; B65B 39/06; B65B 39/001; B65B 39/00; B65B 39/007; B65B 43/42; B65B 43/54; B65B 43/50; B65B 43/60; B65B 43/46; B65B 43/465; B65B 55/022; B65B 67/04; B65B 35/04; B65H 7/04; B65H 31/06

USPC ..... 53/570, 571, 255, 258

See application file for complete search history.

(56) References Cited

U.S. PATENT DOCUMENTS 2,654,518 A * 10/1953 Kindseth ..... B65B 43/58 141/75

2,903,230 A * 9/1959 Schachte ..... G01G 13/00 177/118

(Continued)

OTHER PUBLICATIONS

Europe Patent Office, "Search Report for European Patent Application No. 18184139.6," dated Sep. 26, 2018.

*Primary Examiner* — Dariush Seif

(74) *Attorney, Agent, or Firm* — Manabu Kanesaka

(57) ABSTRACT

An apparatus includes a hopper, having a vent for articles, for storing articles; an arm connected to the vent of the hopper, for moving the position of the vent along with rotation around a rotating shaft, one end portion of the arm as an elongated member being connected to the rotating shaft extending in a horizontal direction; and a bag attachment portion including a bag support portion for supporting a bag into which articles are loaded, an attachment structure body for attaching an opening portion of the bag and a movable member for moving freely to a condition where the bag support portion is positioned at an appropriate inclined angle with respect to a horizontal direction. The vent of the hopper is adjustable to be positioned above the position of the opening portion of the bag supported when the arm and the bag attachment portion are moved.

4 Claims, 7 Drawing Sheets

(51) Int. Cl.

| | |
|---|---|
| ***B65B 55/02*** | (2006.01) |
| ***B65B 39/06*** | (2006.01) |
| ***B65B 1/30*** | (2006.01) |
| *B65B 39/00* | (2006.01) |
| *B65B 35/04* | (2006.01) |
| *B65H 7/04* | (2006.01) |
| *B65H 31/06* | (2006.01) |

(56) References Cited

U.S. PATENT DOCUMENTS 3,335,769 A * 8/1967 Ilg ..... B65B 39/06 141/340
3,578,041 A * 5/1971 Obara ..... B65B 1/18 141/59
4,078,358 A * 3/1978 Henderson ..... B65B 39/08 53/459
4,526,214 A * 7/1985 McGregor ..... B65B 1/28 141/114
4,612,965 A * 9/1986 McGregor ..... B65B 43/18 141/114
4,887,475 A * 12/1989 Austin ..... B65B 1/04 73/866
5,056,299 A * 10/1991 Furukawa ..... B65B 43/18 53/258
5,115,619 A * 5/1992 Lieder ..... B65B 1/34 141/313
5,372,000 A * 12/1994 Altermatt ..... B65B 43/52 53/373.2
5,447,699 A * 9/1995 Papciak ..... A61L 2/26 422/294
5,535,792 A * 7/1996 McGregor ..... B65B 39/00 141/129
5,687,551 A * 11/1997 Mustain ..... B65B 1/32 141/10
5,771,667 A * 6/1998 McGregor ..... B65B 39/08 53/284.7
6,094,891 A * 8/2000 Savigny ..... B65B 43/36 141/145
6,295,790 B1 * 10/2001 McGregor ..... B65B 1/28 53/374.3
7,421,834 B1 * 9/2008 Doolan ..... B65B 1/366 53/570
8,943,783 B2 * 2/2015 Ouellet ..... B65B 43/46 53/138.7
2005/0060955 A1 * 3/2005 Porter ..... B65B 25/06 53/244
2008/0283145 A1 * 11/2008 Maxwell ..... B65B 5/067 141/114
2011/0239595 A1 * 10/2011 Jones ..... B65B 1/06 53/473
2012/0144779 A1 * 6/2012 Brinkman ..... B65B 43/28 53/432
2013/0160400 A1 * 6/2013 Decio ..... B65B 1/04 53/284.7

* cited by examiner

10

10

10

ARTICLE LOADING APPARATUS

RELATED APPLICATIONS

The present application is based on, and claims priority from, Japanese Application No. JP2017-143571 filed Jul. 25, 2017, the disclosure of which is hereby incorporated by reference herein in its entirety.

TECHNICAL FIELD

The present invention relates to an article loading apparatus, more specifically an article loading apparatus for loading articles into a predetermined bag.

BACKGROUND ART

It is necessary to pay a close attention to a treatment of medical articles, e.g., products or their components for providing medical services. Especially, it is necessary to keep a sterile condition from a production step of articles, during a transportation of the articles to a location of use, and to the use of the articles.

During a series of these steps, it is common to use a handling method for loading articles into a sterile bag like a port bag keeping a cleanliness of the articles and transporting the sterile bag by keeping the articles in the sterile bag in order to transport the articles keeping a sterile condition.

DISCLOSURE OF INVENTION

Problems to be Resolved by the Invention

However, it takes a lot of trouble to load articles into a sterile bag keeping a cleanliness as compared to a case of simply loading articles into a bag. It is more difficult to handle a lot of articles at one time during an article loading operation while maintaining a cleanliness, and in a lot of cases it is naturally necessary to load a small number of articles into each of many sterile bags. As a result, it often results in increased time and effort of transporting operation.

For this purpose, it has been desired to develop an article loading apparatus for loading articles into a sterile bag as many as possible at one time by steps and labors as little as possible.

Means for Solving the Problems

In order to resolve the aforementioned problems, an article loading apparatus according to the present invention comprises a hopper for storing articles, having a vent for the articles; an arm for moving the position of the vent of the hopper, which is an elongated member connected with the hopper, one end portion of the elongated member is connected with a rotating shaft extending in a horizontal direction, the arm rotates around the rotating shaft, connected with the arm, along with a rotation; a bag attachment portion including a bag support portion for supporting a bag into which articles are loaded, an attachment structure body for attaching the bag to fix the opening portion of the bag and a movable member for moving the bag support portion freely to a condition where the bag support portion is positioned at an appropriate inclined angle with respect to a horizontal direction; wherein the vent of the hopper is adjustably positioned above the position of the opening portion of the bag, supported at an appropriate inclined angle by the bag support portion, by moving the arm and moving the bag attachment portion.

Effect of Invention

An article loading apparatus according to the present invention has an effect of enabling a process of putting a number of articles into a predetermined bag by steps and labors as little as possible, for example.

A MODE FOR IMPLEMENTING THE INVENTION

Figure 1:
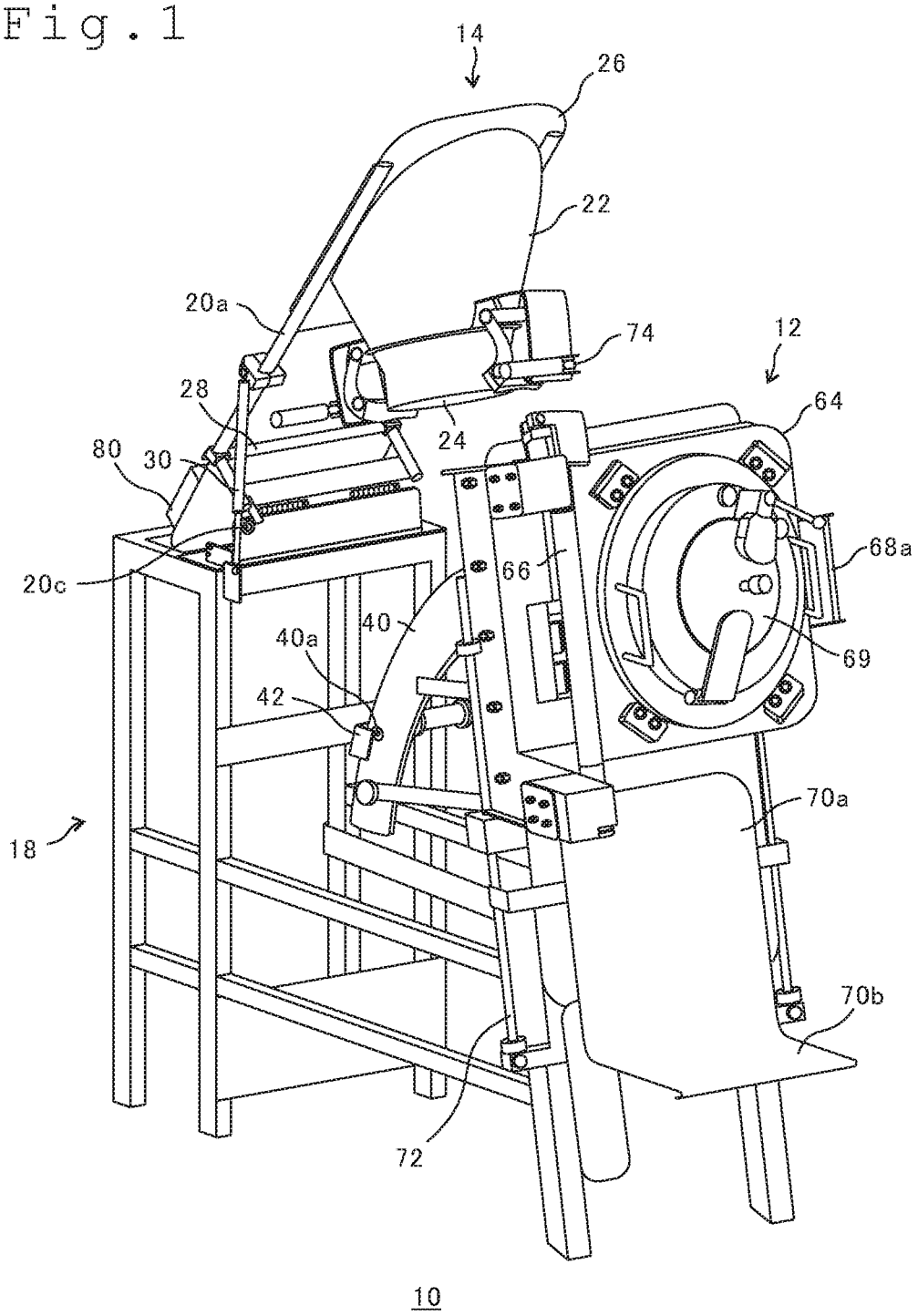
FIG. 1 shows a perspective view of one embodiment of an article loading apparatus according to the present invention.
Figure 2:
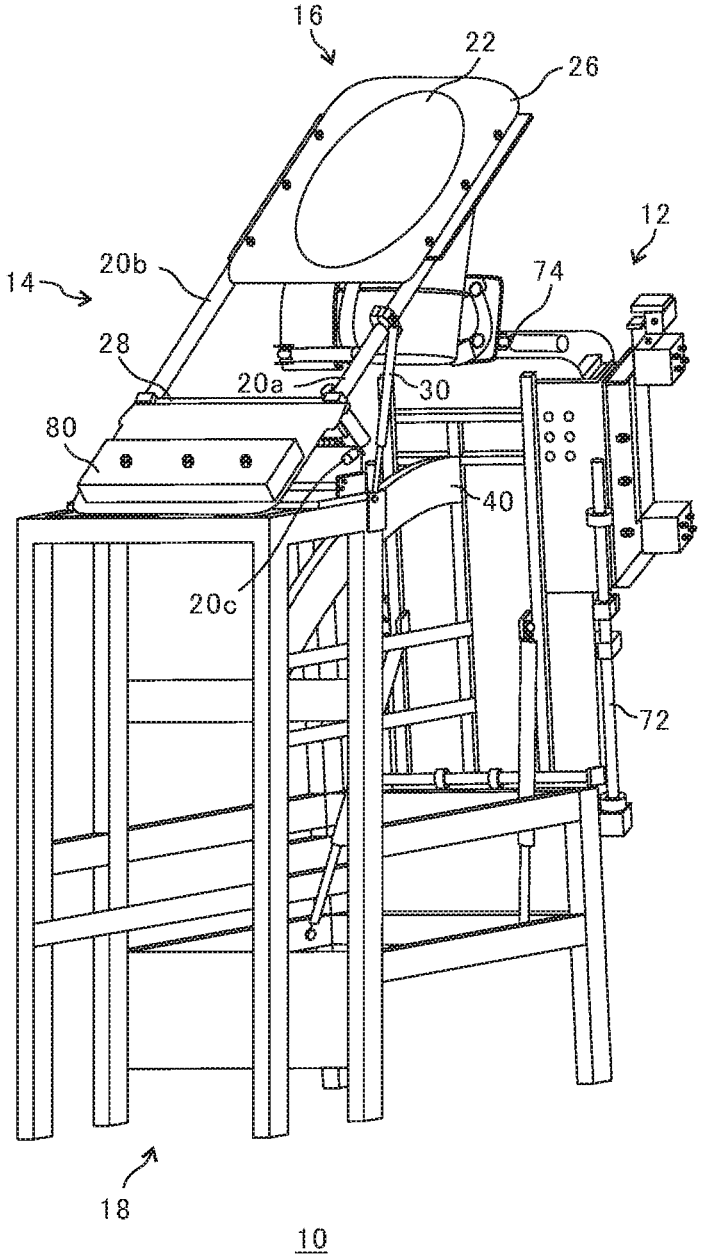
FIG. 2 shows a perspective view of the embodiment of an article loading apparatus according to the present invention shown in FIG. 1 from an alternative angle.

Next, one embodiment of an article loading apparatus according to the present invention will be explained in detail referring to the attached drawings. This embodiment of an article loading apparatus 10 according to the present invention is divided broadly into a bag attachment portion 12 for attaching a bag into which articles are to be stored so that the articles can be loaded into a predetermined bag and a hopper portion 14 for loading the articles into the bag through an ingate of the bag which is attached to the bag attachment portion 12. FIG. 1 and FIG. 2 show perspective views of one embodiment of the article loading apparatus 10 according to the present invention, FIG. 1 shows a perspective view of the condition where the bag attachment portion 12 is exposed closer to the front side than the hopper portion 14, and FIG. 2 shows a perspective view of the condition where the hopper portion 14 is exposed closer to the front side than the bag attachment portion 12.

The perspective views of FIG. 1 and FIG. 2 illustrate the article loading apparatus 10 according to the present invention schematically. Therefore, the illustration of some of the constitutional elements having little relevance to the understanding of the present invention are simplified or omitted. The illustration of some part of the constitutional elements are simplified or omitted also in the drawings of FIG. 3 and later.

Figure 3:
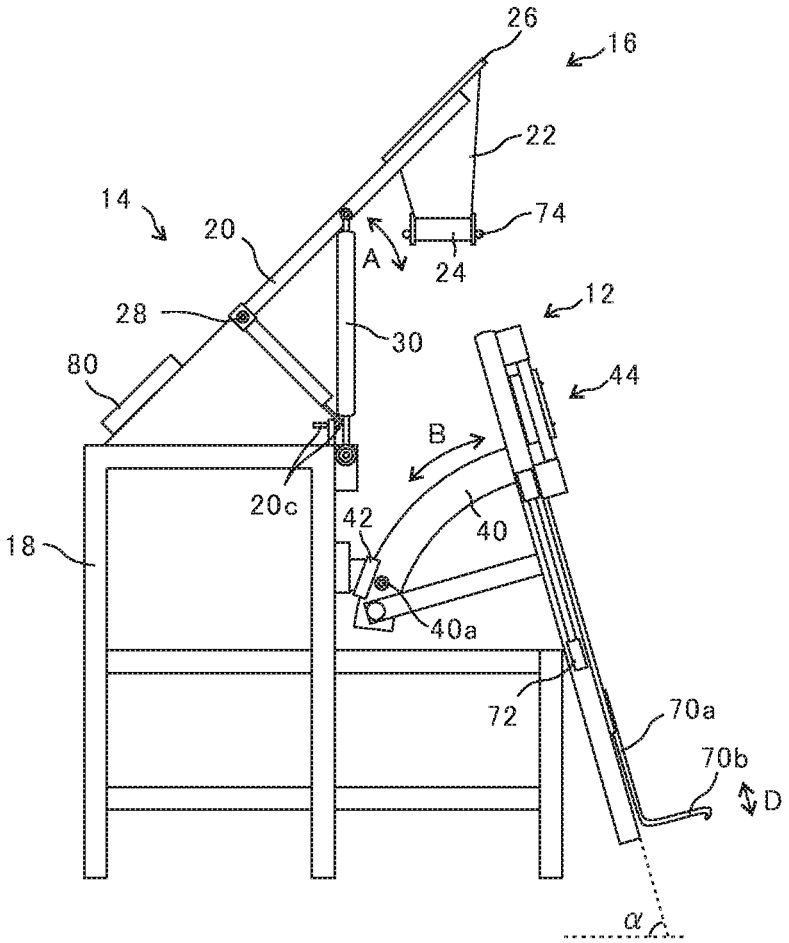
FIG. 3 shows a front view of the embodiment shown in FIG. 1.

As shown in FIG. 3 especially, the hopper portion 14 is a container for storing articles temporary, having a hopper 16 for putting articles into the opening portion of the bag and a base portion 18, being positioned under the hopper portion 14, for supporting the hopper portion 14 in whole. The hopper portion 14 has an arm 20 which is an elongated member, one end of the elongated member is attached to the base portion 18 rotatably and the other end of the arm 20 is attached to the hopper 16. By such a configuration, the hopper 16 is supported by the base portion 18 via the arm 20. The position, especially the height of the hopper 16, which is attached to the other end of the arm 20, can be changed by rotating around one end of the arm 20 as the pivot point.

The hopper 16 comprises a hopper body 22, having an opening at the top edge portion and a width of the internal space of the container becoming smaller gradually toward the lower side. By such a configuration, it is possible to store articles temporary by loading the articles through the top edge open portion of the hopper body 22. It is preferable to have a shape of an inverted truncated cone or an inverted truncated pyramid as the appearance of the hopper body 22.

The hopper 16 also includes a vent portion 24, which is positioned at the lower portion of the hopper body 22, having a form of a cylinder or a square tube in accordance with the shape of the hopper body 22, the lowest end portion is open-ended or with an openable and closable cover portion. The vent portion 24 has an open lowest end portion, and this open portion works as a vent for articles which were put into the hopper 16.

The hopper 16 also comprises a flange portion 26, extending outward from a portion constituting the edge of the top edge open portion of the hopper body 22 and being connected to the arm 20 so that the flange portion 26 is supported by the arm 20. This support makes the connection between the hopper 16 and the arm 20 stronger.

Figure 4:
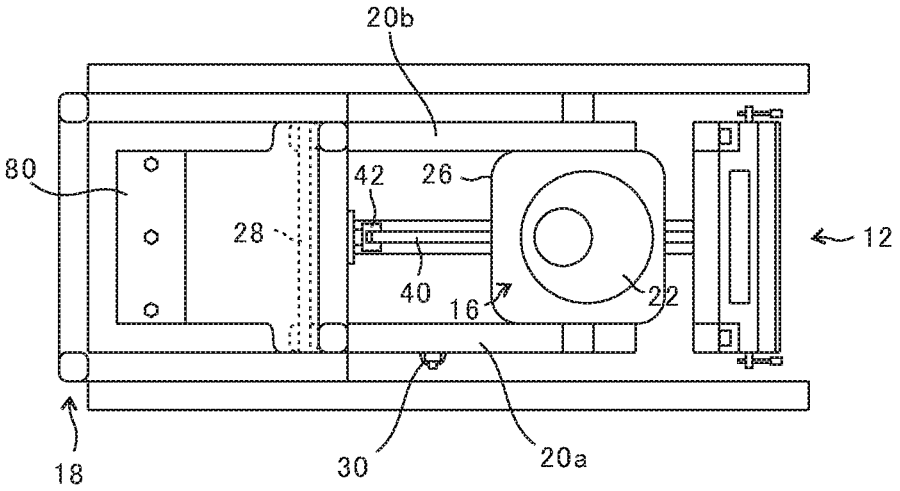
FIG. 4 shows a top view of the embodiment shown in FIG. 1.

As shown in FIG. 4 which shows a top view, the arm 20 comprises an arm 20*a* and an arm 20*b*, which support the hopper 16 at each side of the flange portion 26 of the hopper 16 respectively. The arm 20*a* and the arm 20*b* are positioned in parallel each other, and the arm 20*a* is fixed to one end of a rotating shaft 28 and the arm 20*b* is fixed to the other end of the rotating shaft 28. By such a configuration, the arm 20*a* and the arm 20*b* can rotate integrally according to the rotation of the rotating shaft 28 (see the arrow A in FIG. 3). The rotating shaft 28 extends in a horizontal direction. When the arm 20*a* and the arm 20*b* rotate integrally, the hopper supported by the arm 20*a* and the arm 20*b* also rotates in tandem with them.

It is preferable to attach a damper 30 to the hopper 14, one end of the damper 30 is attached to the base portion 18 and the other end of the damper 30 is attached to at least one of the arm 20*a* and the arm 20*b*, to ensure a smooth rotation and prevent vibrations from transmitting to the arm 20 and the hopper 16 especially during rotation. The damper 30 may have a structure utilizing a viscous resistance of oil, a structure utilizing an elastic body, e.g., spring, rubber, or a combination of these structures.

It is also preferable to provide an anchorage 20*c* for preventing an unintended rotation by fixing the arm 20 to a desired position by a predetermined operation so that the position of the hopper 16 will not change further by a cause, e.g., the weight of articles loaded into the hopper 16 after the hopper 16 is set to a desired position. The method for fixing the arm 20 or preventing the arm 20 from an unintended rotation may be any known method, e.g., setting a weight 80 (FIG. 2) at the other side of the hopper 16 to keep a balance with the hopper 16 or providing the damper 30 described above.

The bag attachment portion 12 is elected at right angle or at nearly right angle, for example. It is possible to adjust an inclined angle (a) to a sharper angle when articles are loaded into a bag which is attached to the bag attachment portion 12 through the hopper 16. The elected angle in the initial condition can be set at an appropriate angle which is not limited to a right angle or a nearly right angle in light of the storage space of the article loading apparatus 10, the easiness of a removing operation of the cover of the bag by a user which will be described later. The inclined angle of the bag attachment portion 12 which is to be adjusted when articles are loaded into a bag, more specifically the inclined angle of a bag support member which will be described later, is adjusted appropriately by a user every time the loading operation is conducted because the most suitable loading angle varies depending on the material and shape of the articles to be loaded.

In order to realize such an adjustment to the most suitable inclined angle, one end of a movable member 40 for moving the bag attachment portion 12, for example one end of an arc shaped slide member 40 is connected to the rear side of the bag attachment portion 12, more specifically the side which is opposite to the side where a bag is to be attached.

In this embodiment, a guide member 42 is attached to the base portion 18 of the hopper portion 14 to guide the sliding direction of the slide member 40. The guide member 42 and the slide member 40 are connected so that they can slide each other freely. When the slide member 40 slides in an arc being guided in a moving direction by the guide member, the bag attachment portion which is connected to the slide member 40 also rotates in conjunction with the slide member 40 (see the arrow B in FIG. 3).

It is preferable to prevent the inclined angle of the bag attachment portion 12 from changing further by a cause, e.g., the weight of the articles which is loaded into the attached bag, after the bag attachment portion 12 is positioned at a desired angle. Therefore, it is preferable to put an anchorage 40*a* on the bag attachment portion 12 or the slide member 40 to fix the bag attachment portion 12 at a desired angle by a predetermined operation. The way for fixing the bag attachment portion 12 or preventing an unintended rotation may be any known means, e.g., an anchorage, a weight, a damper, which were previously explained.

The bag attachment portion 12 has an attachment structure body 44 which is formed in a form which can attach a bag to the article loading apparatus 20 in a fixed manner. As the ways of fixed attachment by the attachment structure body 44, there can be attaching methods, e.g., locking, latching, engaging, depending on the shape of the opening portion of the bag.

One example of the structure of the attachment structure body 44 and one example of the method for attaching a bag will be explained referring to FIG. 6(A) to FIG. 6(D). It is most suitable to use the article loading apparatus 10 according to the present invention for loading articles which is necessary to be transported keeping a sterile condition, especially medical articles into a bag.

Therefore, the material and structure of the bag, especially the structure of the opening portion has a configuration which is advantageous to a sterilization process and the maintenance of a sterile condition.

Figure 6A:
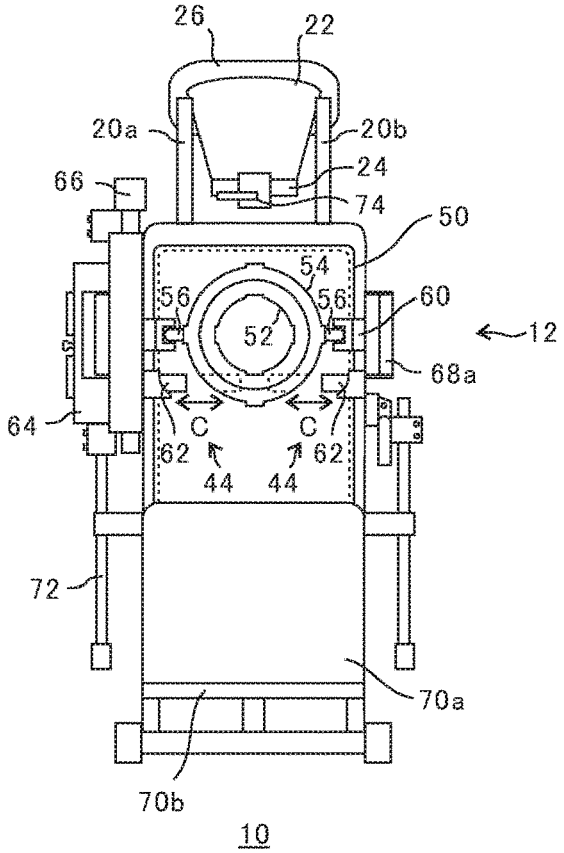
FIG. 6(A) shows an operating example of attaching a bag to the bag attachment portion of FIG. 5, and FIG. 6(B) to FIG. 6(D) show configuration examples of bags used in the apparatus according to the present invention.
Figure 6B:
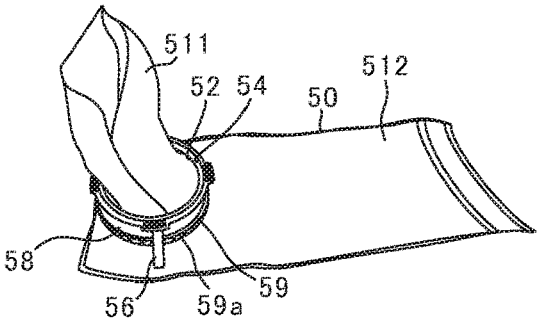
Figure 6C:
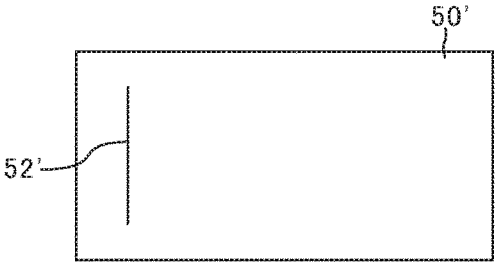
Figure 6D:
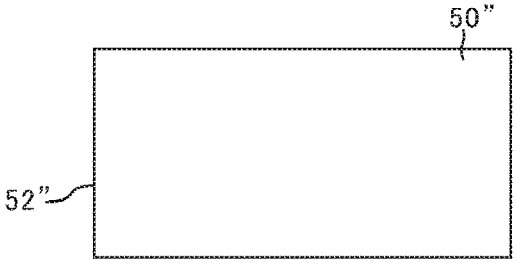

One example of the structure of a bag 50 is shown in FIG. 6(B) to FIG. 6(D). An outer peripheral member 54 formed by, for example, a synthetic resin is provided to enclose the outer peripheral portion of a circular opening portion 52 of the bag 50. The bag 50 is formed in nearly a rectangle shape as a whole and the opening portion 52 and the outer peripheral member 54 are arranged on one side of the bag 50. When the longitudinal direction of the bag is aligned with the vertical direction, the opening portion 52 is positioned at the upper portion of the bag. Each horizontal end portion of the outer peripheral member 54 has a protruding member 56 respectively, and each protruding member 56 extends in a horizontal direction. And, a wall portion 58 having a flange portion 59 and a recessed portion 59*a* is provided under the protruding members 56.

The aforementioned bag 50 has a multiple structure including an inner bag 511 and an outer bag 512 as shown in FIG. 6(B), for example, and the inner bag 511 can be drawn out outside the bag through the opening portion 52 as shown in the drawing.

Naturally, the bag may be a bag 50' which does not have a complicated structure, e.g., the outer peripheral member 54, for example, the bag may have an appearance of a rectangle shape which has the same shape as the bag 50 and may have a slit-shaped opening portion 52' at an appropriate position (in this example, the same position as that of the bag 50) as shown in FIG. 6(C), and a closing means, e.g., a snap-button, a fastener, may be provided at an opening portion 52' and an inner bag may be drawn out through the opening portion 52' in the same manner as the bag 50, although it is not shown in the drawings. The bag 50' may have a single structure, not a multiple structure.

As shown in FIG. 6. (D), it is also possible to position the opening portion across the entire length of one of a short side 52" of the rectangular bag 50" or partially at an appropriate portion, e.g., the center portion, one end or the both ends of the short side 52". Although it is not shown in the drawings, it is also possible to provide a closing means, e.g., a snap button, a fastener, at the opening portion 52', or make the bag 50" to have a double structure including an outer bag and an inner bag to enable the inner bag to be drawn out from the opening portion 52" as same as the cases of the bag 50 and the bag 50'.

In the bag attachment portion 12, the attachment structure body 44 has a structure described below so that the aforementioned outer peripheral member 54 can be attached when the bag 50 having a structure shown in FIG. 6(B) is used.

That is to say, the attachment structure body 44 has a fixing member 60 for fixing each of the protruding members 56 which are protruding from the both sides of the outer peripheral member 54 of the bag 50. This fixing method may be any appropriate method, e.g., supporting, sandwiching, holding together, engaging. The attachment structure body 44 further includes an insert member 62 which is movable to be inserted into a recessed portion 59*a* constituted by a flange portion 59 which is positioned beneath the wall portion 58 included in the outer peripheral member 54. The fixation between the bag 50 and the bag attachment portion 12 becomes stronger by moving the iliseLL member 62 in a direction of the arrow C in FIG. 6(A) so as to be inserted into the recessed portion 59*a*.

In view of the maintenance of a sterile condition of articles loaded into a bag, it is preferable that a cover is provided at the opening portion 52 of the bag 50, the aforementioned closing means like a fastener, etc., are provided at the opening portion 52', 52" of the bag 50', 50" and the opening portion 50, 50', 50'" has a sealable structure.

Therefore, in the case of the bag 50 shown in FIG. 6(B), the bag attachment portion 12 preferably has a cover attaching and removing mechanism 64 for attaching a cover to the opening portion 52 of the bag 50 and removing the attached cover from the opening portion 52 of the bag 50. In this case, it is preferable to position the opening portion 52 of the bag 50 on one side of the bag, namely the front side.

In the case of the bag 50', 50" shown in FIG. 6(C) and FIG. 6(D) which does not have complicated structures like the outer peripheral member 54, although it is sufficient to attach the opening portion 52', 52" to the cover attaching and removing mechanism 64 after opening the opening portion 52', 52", it is preferable to install a covering means like a cover at the cover attaching and removing mechanism 64 beforehand for covering the opening portion 52', 52" in order to prevent foreign objects from entering into the bag 50', 50".

It is possible to use a known method for attaching and removing a cover and a known structure of the cover attaching and removing mechanism 64 for realizing the method for attaching and removing. That is to say, it is possible to design the cover attaching and removing mechanism 64 appropriately depending on the structure of the cover on the side of the bag or the opening portion.

Figure 5:
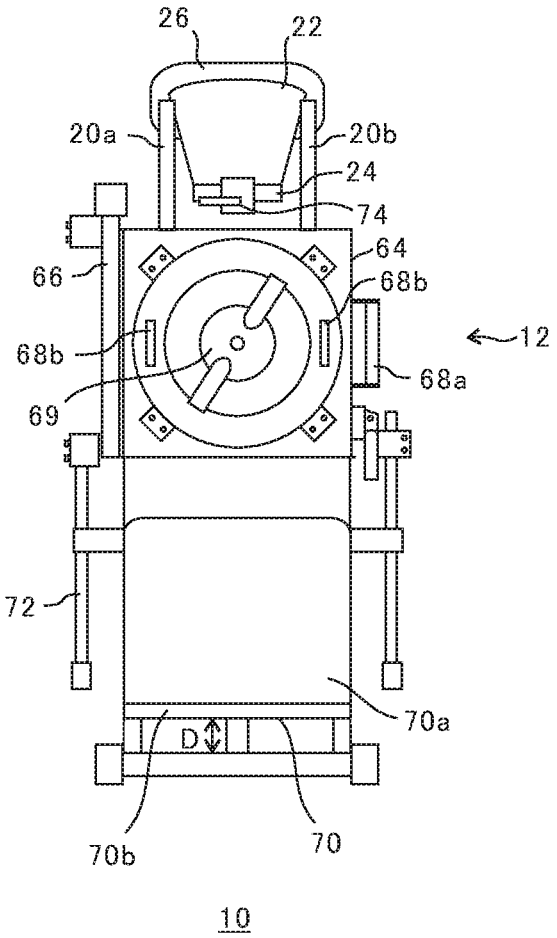
FIG. 5 shows a view of the embodiment shown in FIG. 1 viewed from the side where a bag attachment portion of the article loading apparatus is positioned.

For example, when the outer peripheral member 54 is provided as shown in FIG. 6(B), the cover attaching and removing mechanism 64 is a door body shaped mechanism for rotating around a rotating shaft 66 which is set vertically, and the cover attaching and removing mechanism 64 is in a condition where the door is closed as shown in FIG. 5 as an initial condition when the article loading apparatus 10 is stored. The cover attaching and removing mechanism 64 is set in a position where it covers the attachment structure body 44 in an initial condition, and when the door body shaped cover attaching and removing mechanism 64 is rotated around the rotating shaft 66, the attachment structure body 44 is exposed on the outer surface, and then it becomes possible for a user to attach the bag 50 to the attachment structure body 44 by the method shown in FIG. 6(A).

The cover attaching and removing mechanism 64 is rotated when a user pulls a handle 68*b*, for example. After the bag 50 is attached to the attachment structure body, the door body shaped cover attaching and removing mechanism is closed again and the appearance returns to the condition shown in FIG. 5. Then, a user can operate the cover attaching and removing mechanism 64 to attach only the cover portion to the bag 50 or remove only the cover portion from the bag 50 when it is necessary. For example, only the cover of the bag 50 is removed keeping a fixed condition of the outer peripheral member 54, when a user rotates the bag 50 to a predetermined direction by holding each of the handles 68*b* by each hand respectively keeping the bag 50 in a fixed condition. After this operation, by pulling an inner door 69, the cover of the bag 50 is removed from the bag body along with the movement of the inner door 69.

The bag attachment portion 12 and the hopper portion 14 are also rotatable in a predetermined angle range. It is preferable to position the vent portion 24 of the hopper 16 in a nearly vertical direction above the position where the opening portion 52, 52', 52" of the bag 50, 50', 50" is positioned, the bag 50, 50', 50" is attached to the bag attachment portion 12 which is set at a desired inclined angle, in order to load articles smoothly through the hopper portion 14 into the bag 50, 50', 50" which is attached to the bag attachment portion 12.

The height of the attached bag 50, 50', 50" is varied, and it becomes necessary to support the bag 50, 50', 50" from underneath as articles are loaded into the bag. When the inclined angle of the bag attachment portion 12 with respect to the horizontal plane is small, it also becomes necessary to support the rear side of the bag 50, 50', 50". Therefore, it is preferable for the article loading apparatus 10 to have a bag support portion 70 which supports the rear side portion and the bottom portion of the bag 50. The bag support portion 70 has a rear side support portion 70*a* which is a plate shaped body for supporting mainly the rear side of the bag 50, 50', 50", the side which is the opposite sides to the side where the opening portion 52, 52' is positioned in the bag 50, 50' shown in FIG. 6(B), FIG. 6(C), and a bottom support portion 70*b* for supporting mainly the bottom portion of the bag 50, 50', 50", which is attached vertically to the rear side support portion 70*a* at its lower end portion.

It is possible to support the bag 50, 50', 50" which are attached to the bag attachment portion 12 at an inclined angle which is most suitable to a process for loading articles into a bag by the adjustment with the movable member 40 which makes the inclined angle of the bag attachment portion 70, especially the inclined angle of the rear side support portion 70*a* with respect to a horizontal direction, adjustable appropriately.

The length of the bag support portion 70 in an up-and-down direction is adjustable when a user operates an adjustment equipment 72 like an adjustment rod, for example, when a user rotates the adjustment rod around the axis extending a longitudinal direction as the central axis. By this adjustment operation, the bag support portion 70 moves in the up-and-down direction (the direction of the arrow D shown in FIG. 5). It is possible to constitute so that only the bottom side support portion 70*b* out of the bag support portion 70 is movable on the plate which constitutes the rear side support portion 70*a*.

By the way, this embodiment of the article loading apparatus 10 according to the present invention is the most suitable apparatus which is used when articles which are necessary to keep a sterile condition like medical articles are loaded into a bag. Therefore, it is preferable to use a bag which has a multiple structure including an inner bag and an outer bag as described above, and it may be a port bag 50 which has an outer peripheral member 54 as described above.

By using such a multiple structure, it can be easy to conduct a sterilization process and keep a sterility in a bag, and it is possible to keep a sterility inside the inner bag even when the outer bag is broken.

When the bag 50, 50', 50" has such a multiple structure, it is better to fix the inner bag 511 to the vent portion 24 so as to cover the vent portion 24 of the hopper with the inner bag 511 by drawing out the inner bag 511 as shown in FIG. 6(B) prior to the loading of articles. By covering in this manner, it becomes easy to load articles keeping a cleanliness because the vent portion 24 is positioned above the opening portion 52 even if the bag attachment portion 12 and the hopper portion 14 are not adjusted so that the vent portion 24 of the hopper 16 is positioned just vertically right above or nearly vertically right above the opening 52 of the bag 50 which is attached to the bag attachment portion 12.

It is preferable to attach the bag fixing equipment 74 to the hopper 16 for fixing the bag 50, 50', 50" so that the covering bag 50, 50', 50" will not come away. For a fixing method, any known method, e.g., sandwiching the inner bag between the vent portion 24 and the bag fixing equipment 74, providing a member for engaging the bag with the bag fixing equipment 74, may be used.

As a material for forming each member constituting the bag attachment portion 12 and the hopper portion 14, it is preferable to use stainless or other metal which has a high stiffness in some degree and is easy to be subject to sterilization treatment as far as possible except for constitutional elements like the damper 30 requiring a predetermined elasticity and other properties.

Next, an operation of the embodiment of the article loading apparatus 10 according to the present invention will be explained. As shown in FIG. 3, in the initial setting condition of the article loading apparatus 10, the bag attachment portion 12 is elected at an inclined angle which is nearly vertical with respect to a horizontal plane. The arm 20 of the hopper portion 14 is also positioned at an angle as large as possible with respect to a horizontal plane within the range where the arm 20 is rotatable. That is to say, the hopper 16 attached to the arm 20 is positioned at a position as high as possible.

First, a user attaches the bag 50, 50', 50" to the bag attachment portion 12 when the user intends to load articles into the bag 50, 50', 50".

One example using the bag 50 will be explained below.

A user attaches the bag 50 to the attachment structure body 44 which is exposed by opening the door body shaped cover attaching and removing mechanism 64, and rotates the cover attaching and removing mechanism 64 to close the door again. It is also possible to operate the adjustment equipment 72 depending on the size of the bag 50 attached to the bag attachment portion 12.

Figure 7:
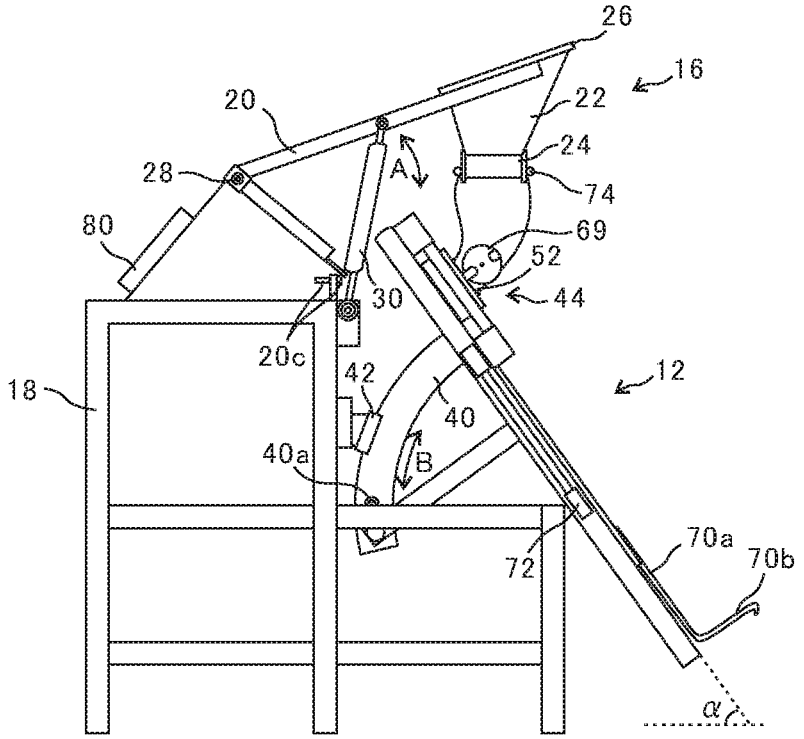
FIG. 7 shows one example of the operation of the article loading apparatus shown in FIG. 3.

Next, as shown in FIG. 7, the bag attachment portion 12 with the attached bag 50 is inclined to a desired angle (see the arrow B). The preferable inclined angle $\alpha$ of the bag attachment portion 12 varies depending on the shape and the material of articles to be loaded into the bag 50 through the hopper 16 and the capacity of the bag. It is preferable to fix the bag attachment portion 12 at a desired inclined angle by operating the fixing equipment 40*a*, after a user adjusts the bag attachment portion 12 to a desired inclined angle. The cover of the bag 50 is kept detached before or after the adjustment of the bag attachment portion 12 to a desired inclined angle.

Next, as shown in FIG. 7, the vent portion 24 of the hopper 16 is adjusted to be positioned above, preferably vertically above, the opening portion 52 of the bag 50 which is attached to the bag attachment portion 12 (see the arrow A). It is preferable to fix the arm 20 and the hopper 16 at a desired position by operating the fixing equipment 20*c*, after a user adjusts the arm 20 to a desired position. It is better to cover the vent portion 24 with the inner bag 511 and fix it by the bag fixing equipment 74 to prevent the inner bag from detaching if the bag 50 has a multiple structure.

Articles for putting into a bag are loaded toward the opening portion 52 of the bag 50 through the upper end opening portion of the hopper body 22, after adjusting the bag attachment portion 12 and the arm 20 to a desired position as shown in FIG. 7. The inclined angles of the bag attachment portion 12 and the arm 20 may be appropriately adjusted depending on the volume of articles loaded into the bag during the loading process of articles.

It is preferable that the articles which is to be loaded into the bag 50 using the article loading apparatus 10 are articles which have a predetermined elasticity like rubber-made articles. However, it is not necessary to limit the material and the shape of articles particularly if the loaded volume and the inclined angle of the bag attachment portion 12 are carefully adjusted not to damage or not to defame the articles during loading.

When the loading operation of articles into the bag 50 is completed, the arm 20 is rotated so as to move the hopper 16 upward, and then an additional or a supplemental sterilization process is conducted with respect to the inside of the bag 50 as needed, and the cover is attached to the bag 50 again.

Finally, the bag 50 with loaded articles and with a closed cover is removed from the bag attachment portion 12, and a user transports it to a desired location by an appropriate method.

By using such a method, the efficiency of loading articles into the bag 50 improves. It becomes possible to load more articles into the bag 50 at one time with fewer labors in comparison with conventional methods. Therefore, the transportation efficiency of articles in the bag 50 improves.

It is also possible to design a structure which is suitable for handling by robots or machines for each portion of the structure of the article loading apparatus 10 according to the present invention.

EXPLANATION OF REFERENCES

10 article loading apparatus
12 bag attachment portion
16 hopper
20 arm
20*c* arm fixing equipment
24 vent portion
40 movable member
40*a* movable member fixing equipment
44 attachment structure body
70 bag support portion

The invention claimed is:

1. An article loading apparatus, comprising a hopper for storing articles, having a vent for the articles;

an arm, which is an elongated member connected with the hopper, one end portion of the elongated member is connected to a rotating shaft extending in a horizontal direction, the arm rotates around the rotating shaft for moving the position of the vent of the hopper along with the rotation;

a bag attachment portion including a bag support portion for supporting a bag into which an article is loaded, an attachment structure body for attaching the bag to fix the opening portion of the bag, and a movable member for moving the bag support portion for supporting the bag freely to a condition where the bag support portion has an appropriate inclined angle with respect to a horizontal direction; wherein, the vent of the hopper is adjustably positioned above the position of the opening portion of the bag which is supported at an appropriate inclined angle by the bag support portion, by moving the arm and moving the bag attachment portion.

2. An article loading apparatus according to claim 1, wherein the vent of the hopper is adjustably positioned nearly vertically above the position of the opening of the bag which is supported at the appropriate inclined angle by the bag support portion.

3. An article loading apparatus according to claim 1, wherein the movable member, included in the bag attachment portion, comprises a slide member for sliding the bag attachment portion so that the bag is supported at an inclined angle within a predetermined range by the bag support portion.

4. An article loading apparatus according to claim 1, wherein the arm includes a first fixing equipment for fixing the arm which is rotated to an appropriate position, and the bag attachment portion includes a second fixing equipment for fixing the bag attachment portion which is rotated to an appropriate inclined angle.

* * * * *